US008678951B2

(12) United States Patent
Sullivan et al.

(10) Patent No.: US 8,678,951 B2
(45) Date of Patent: Mar. 25, 2014

(54) MULTI-LAYER COVER GOLF BALL HAVING THERMOSET RUBBER INTERMEDIATE COVER LAYER

(75) Inventors: Michael J. Sullivan, Barrington, RI (US); William E. Morgan, Barrington, RI (US); Brian Comeau, Berkley, MA (US); Douglas S. Goguen, New Bedford, MA (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 867 days.

(21) Appl. No.: 12/717,543

(22) Filed: Mar. 4, 2010

(65) Prior Publication Data

US 2011/0218056 A1 Sep. 8, 2011

(51) Int. Cl.
*A63B 37/06* (2006.01)

(52) U.S. Cl.
USPC ..... 473/376

(58) Field of Classification Search
USPC ..... 473/376
See application file for complete search history.

(56) References Cited

U.S. PATENT DOCUMENTS

| | | | |
|---|---|---|---|
| 5,006,297 | A | 4/1991 | Brown et al. |
| 5,334,673 | A | 8/1994 | Wu |
| 5,484,870 | A | 1/1996 | Wu |
| 5,733,428 | A | 3/1998 | Calabria et al. |
| 6,056,650 | A | 5/2000 | Yamagishi et al. |
| 6,117,025 | A | 9/2000 | Sullivan |
| 6,132,324 | A | 10/2000 | Hebert et al. |
| 6,152,834 | A | 11/2000 | Sullivan |
| 6,162,135 | A | 12/2000 | Bulpett et al. |
| 6,180,040 | B1 | 1/2001 | Ladd et al. |
| 6,180,722 | B1 | 1/2001 | Dalton et al. |
| 6,291,592 | B1 | 9/2001 | Bulpett et al. |
| 6,394,914 | B1 | 5/2002 | Sullivan |
| 6,458,895 | B1 | 10/2002 | Wrigley et al. |
| 6,465,578 | B1 | 10/2002 | Bissonnette et al. |
| 6,506,851 | B2 | 1/2003 | Wu |
| 6,685,579 | B2 | 2/2004 | Sullivan |
| 6,685,580 | B2 | 2/2004 | Sullivan |
| 6,736,737 | B2 | 5/2004 | Higuchi et al. |
| 6,743,122 | B2 | 6/2004 | Hayashi et al. |
| 6,835,794 | B2 | 12/2004 | Wu et al. |
| 7,005,479 | B2 | 2/2006 | Morgan et al. |
| 7,105,610 | B2 | 9/2006 | Wu et al. |
| 7,131,915 | B2 | 11/2006 | Sullivan et al. |
| 7,331,878 | B2 | 2/2008 | Boehm et al. |
| 7,402,271 | B2 | 7/2008 | Morgan |
| 7,427,243 | B2 | 9/2008 | Sullivan |
| 7,491,787 | B2 | 2/2009 | Wu et al. |
| 2002/0151382 | A1* | 10/2002 | Sullivan ..... 473/354 |
| 2008/0293517 | A1* | 11/2008 | Morgan ..... 473/373 |

* cited by examiner

*Primary Examiner* — Raeann Gorden
(74) *Attorney, Agent, or Firm* — William B. Lacy

(57) ABSTRACT

A golf ball including a core and a cover including a thermoplastic inner cover layer having a material hardness of 60 to 80 Shore D; a thermoset outer cover layer comprising a castable polyurea and having a material hardness of 20 to 60 Shore D; and a thermoset intermediate cover layer disposed between the inner and outer cover layers and having a hardness substantially the same as the inner cover layer hardness and greater than the outer cover layer hardness. The inner cover includes one or more high- or low-acid ionomers and, optionally, a maleic anhydride modified polyolefin. The intermediate layer is formed from a castable liquid polybutadiene rubber.

20 Claims, No Drawings

MULTI-LAYER COVER GOLF BALL HAVING THERMOSET RUBBER INTERMEDIATE COVER LAYER

FIELD OF THE INVENTION

This invention relates generally to golf balls, and more specifically, to a golf ball having a cover including at least three layers, the intermediate cover layer being formed from a liquid rubber latex material.

BACKGROUND OF THE INVENTION

The majority of golf balls commercially-available today are of a solid construction. Solid golf balls include one-piece, two-piece, and multi-layer golf balls. One-piece golf balls are inexpensive and easy to construct, but have limited playing characteristics and their use is, at best, confined to the driving range. Two-piece golf balls are generally constructed with a solid polybutadiene core and a cover and are typically the most popular with recreational golfers because they are very durable and provide good distance. These golf balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than are one- and two-piece golf balls.

Wound golf balls, which typically included a fluid-filled center surrounded by a layer of tensioned elastomeric material and a cover, were preferred for their spin and "feel" characteristics but were more difficult and expensive to manufacture than solid golf balls. Manufacturers are continuously striving to produce a solid ball that concurrently includes the beneficial characteristics of a wound ball.

Golf ball playing characteristics, such as compression, velocity, and spin can be adjusted and optimized by manufacturers to suit players having a wide variety of playing abilities. For example, manufacturers can alter any or all of these properties by changing the materials and/or the physical construction of each or all of the various golf ball components (i.e., centers, cores, intermediate layers, and covers). Finding the right combination of core and layer materials and the ideal ball construction to produce a golf ball suited for a predetermined set of performance criteria is a challenging task.

Efforts to construct a multi-layer golf ball have generally focused on the use of one or more cover layers, typically formed from ionomeric and/or polyurethane compositions. It is desirable, therefore, to construct a golf ball formed of a urethane or urea outer cover layer, at least two interior cover layers, and a core of one or more layers. In particular, it is desired that this three-cover-layer construction include an intermediate cover layer formed from a liquid rubber latex material in conjunction with a stiff, resilient thermoplastic inner cover layer.

SUMMARY OF THE INVENTION

The present invention is directed to a golf ball including a core and a three-layer cover. The three-layer cover is formed from an inner cover layer, an intermediate cover layer, and an outer cover layer. The inner cover layer is typically thermoplastic in nature and has a material hardness of about 60 to 80 Shore D. The outer cover layer is thermoset in nature, is formed from a polyurethane, polyurea, or hybrid thereof, and has a material hardness of about 20 to 60 Shore D. The intermediate cover layer is preferably thermoset and, in one embodiment, has a hardness substantially the same as the inner cover layer hardness and both layers have a hardness that is greater than the outer cover layer hardness. The inner cover may be formed from a stiff resilient polymer and the intermediate layer may be formed from a thermoset liquid rubber composition comprising a liquid polybutadiene rubber, a liquid styrenebutadiene rubber, or a liquid ethylene propylene diene monomer (EPDM) polymer.

The liquid rubber composition may include about 30% to 70% solids at a submersion time of about 10 sec to 60 sec. The liquid rubber composition, when in a solid state, can be extended under ambient conditions at least twice its resting length, and upon stress release can return to within 15% of its original length. The liquid rubber composition may further include a crosslinking agent comprising one or more metallic salts of a carboxylic acid. In a preferred embodiment, the liquid rubber composition is a polybutadiene vulcanized with a reactive co-agent, a peroxide, a sulfur, or a mixture thereof. In an alternative preferred embodiment, the liquid rubber composition is a polybutadiene functionalized with epoxy, (meth)acrylate, hydroxyl, vinyl, isocyanate, ester, carboxyl, or carbonyl groups. Additionally, the liquid rubber composition is a polybutadiene comprising (meth)acrylated liquid polybutadiene, epoxidized liquid polybutadiene, liquid polybutadiene dimethacrylate, and liquid polybutadiene urethane diacrylate.

The liquid rubber composition typically has a viscosity of about 10,000 cp or less, more preferably from about 1,000 cp to 10,000 cp, or, optionally, about 1,000 cp or less. The liquid rubber composition may be vulcanized with peroxide or sulfur cure accelerators. In one embodiment, the liquid rubber is an EPDM polymer comprising ethylidene norborene diene monomer or dicyclopentadiene.

The stiff resilient polymer for the inner cover layer may be a partially- and fully-neutralized ionomer, polyolefin, metallocene, polyester, polyamide, thermoplastic elastomer, copolyether-amide, copolyether-ester, or a mixtures thereof.

A combination of the inner cover, the intermediate cover, and the outer cover preferably have a total thickness of about 0.125 inches or less, more preferably about 0.115 inches or less. The outer cover layer is typically cast or reaction injection molded.

The present invention is also directed to a golf ball including a core and a three-layer cover. The three-layer cover includes a thermoplastic inner cover layer disposed directly about the core and having a material hardness of about 60 to 80 Shore D; a thermoset outer cover layer formed from a castable polyurea and having a material hardness of about 20 to 60 Shore D; and a thermoset intermediate cover layer disposed between the inner and outer cover layers and having a hardness substantially the same as the inner cover layer hardness and greater than the outer cover layer hardness. The inner cover layer is typically formed from a high-acid ionomer and the intermediate cover layer is formed from a castable liquid polybutadiene rubber. The inner cover layer may further include a maleic anhydride modified polyolefin.

The present invention is further directed to a golf ball including a core and a three-layer cover. The three-layer cover includes a thermoplastic inner cover layer disposed about the core and having a material hardness of about 60 to 80 Shore D; a thermoplastic polyurethane outer cover layer having a material hardness of about 20 to 60 Shore D; and a thermoset intermediate cover layer disposed between the inner and outer cover layers and having a hardness substantially the same as the inner cover layer hardness and greater than the outer cover layer hardness.

The inner cover layer may include one or more low-acid ionomers and the intermediate cover layer is typically formed from a ethylene propylene diene monomer-based liquid rubber polymer. The inner cover layer may be a blend of Li and Na low-acid ionomers. The outer cover layer is typically cast or reaction injection molded.

DETAILED DESCRIPTION OF THE INVENTION

A golf ball of the present invention includes a core and a cover comprising an outer cover and at least two inner cover layers, such as an inner cover layer and an intermediate cover layer disposed between the outer cover layer and the inner cover layer. The golf ball cores of the present invention may be formed with a variety of constructions. For example, the core may include a plurality of layers, such as a center and an outer core layer. The core, while preferably solid, may comprise a liquid, foam, gel, or hollow center. The golf ball may also include a layer of tensioned elastomeric material, for example, located between the core and triple cover. In a preferred embodiment, the core is a solid core.

Materials for solid cores include compositions having a base rubber, a filler, an initiator agent, and a crosslinking agent. The base rubber typically includes natural or synthetic rubber, such as polybutadiene rubber. A preferred base rubber is 1,4-polybutadiene having a cis-structure of at least 40%. Most preferably, however, the solid core is formed of a resilient rubber-based component comprising a high-Mooney-viscosity rubber and a crosslinking agent.

Another suitable rubber from which to form cores of the present invention is trans-polybutadiene. This polybutadiene isomer is formed by converting the cis-isomer of the polybutadiene to the trans-isomer during a molding cycle. Various combinations of polymers, cis-to-trans catalysts, fillers, crosslinkers, and a source of free radicals, may be used. A variety of methods and materials for performing the cis-to-trans conversion have been disclosed in U.S. Pat. Nos. 6,162,135; 6,465,578; 6,291,592; and 6,458,895, each of which are incorporated herein, in their entirety, by reference.

Additionally, without wishing to be bound by any particular theory, it is believed that a low amount of 1,2-polybutadiene isomer ("vinyl-polybutadiene") is preferable in the initial polybutadiene to be converted to the trans-isomer. Typically, the vinyl polybutadiene isomer content is less than about 7 percent, more preferably less than about 4 percent, and most preferably, less than about 2 percent.

The initiator agent can be any known polymerization initiator which decomposes during the cure cycle. Suitable initiators include peroxide compounds such as dicumyl peroxide, 1,1-di(t-butylperoxy) 3,3,5-trimethyl cyclohexane; a-a bis(t-butylperoxy) diisopropylbenzene; 2,5-dimethyl-2,5 di(t-butylperoxy) hexane; or di-t-butyl peroxide, and mixtures thereof.

Crosslinkers are included to increase the hardness and resilience of the reaction product. The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. Preferred acrylates include zinc acrylate, zinc diacrylate, zinc methacrylate, and zinc dimethacrylate, and mixtures thereof. The crosslinking agent must be present in an amount sufficient to crosslink a portion of the chains of polymers in the resilient polymer component. This may be achieved, for example, by altering the type and amount of crosslinking agent, a method well-known to those of ordinary skill in the art.

When the core is formed of a single solid layer comprising a high-Mooney-viscosity rubber, the crosslinking agent is present in an amount from about 15 to about 40 parts per hundred, more preferably from about 30 to about 38 parts per hundred, and most preferably about 37 parts per hundred.

In another embodiment of the present invention, the core comprises a solid center and at least one outer core layer. When the optional outer core layer is present, the center preferably comprises a high-Mooney-viscosity rubber and a crosslinking agent present in an amount from about 10 to about 30 parts per hundred of the rubber, preferably from about 19 to about 25 parts per hundred of the rubber, and most preferably from about 20 to 24 parts crosslinking agent per hundred of rubber. Suitable commercially-available polybutadiene rubbers include, but are not limited to, CB23, CB22, TAKTENE® 220, and TAKTENE® 221, from Lanxess Corp.; NEODENE® 40 and NEODENE® 45 from Karbochem Ltd.; LG1208 from LG Corp. of Korea; and CISSAMER® 1220 from Basstech Corp. of India. Other rubbers, such as butyl rubber, chloro or bromyl butyl rubber, styrene butadiene rubber, or trans polyisoprene may be added to the polybutadiene for property or processing modification.

Additionally, the unvulcanized rubber, such as polybutadiene, typically has a Mooney viscosity of between about 40 and about 80, more preferably, between about 40 and about 60, and most preferably, between about 40 and about 55. Mooney viscosity is typically measured according to ASTM D-1646.

Fillers added to one or more portions of the golf ball, typically the core, include processing aids or compounds to affect rheological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents, zinc carbonate, regrind (recycled core material typically ground to about 30 mesh or less particle size), high-Mooney-viscosity rubber regrind, and the like. Polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or any or all core and cover layers, if present.

The polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added sequentially.

The cover of the golf ball is a multi-layer cover, preferably comprised of at least three layers, such as an inner cover layer, an intermediate cover layer, and an outer cover layer. While the various cover layers of the present invention may be of any individual thickness, it is preferred that the combination of cover layer thicknesses be no greater than about 0.125 inches, more preferably, no greater than about 0.115 inches, and most preferably, no greater than about 0.105 inches. Any one of the at least three cover layers preferably has a thickness of less than about 0.05 inches, and more preferably, between about 0.010 inches and about 0.045 inches. Most preferably, the thickness of any one of the layers is between about 0.02 inches and about 0.04 inches.

The inner cover can include any materials known to those of ordinary skill in the art, including thermoplastic and thermosetting materials, but preferably include ionic copolymers of ethylene and an unsaturated monocarboxylic acid, such as SURLYN®, commercially-available from DuPont of Wilmington, Del., and IOTEK® or ESCOR®, commercially-available from Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The inner cover materials of this invention can likewise be blended with homopolymeric and copolymer materials such as: (1) vinyl resins, such as those formed by the polymerization of vinyl chloride, or by the copolymerization of vinyl chloride with vinyl acetate, acrylic esters or vinylidene chloride; (2) polyolefins, such as polyethylene, polypropylene, polybutylene and copolymers, such as ethylene methylacrylate, ethylene ethylacrylate, ethylene vinyl acetate, ethylene methacrylic or ethylene acrylic acid or propylene acrylic acid and copolymers and homopolymers produced using a single-site catalyst; (3) non-elastic thermoplastics including polyesters and polyamides, such as poly(hexamethylene adipamide) and others prepared from diamines and dibasic acids, as well as those from amino acids such as poly(caprolactam); non-elastic thermoplastics, including polyethylene terephthalate, polybutylene terephthalate, polyethylene terephthalate/glycol, polyphenylene oxide resins; and blends of non-elastic thermoplastics with SURLYN®, polyethylene, ethylene copolymers, ethylene-propylene diene terpolymer, etc.; (4) thermoplastic rubbers, such as olefinic thermoplastic rubbers including blends of polyolefins with ethylene-propylene diene terpolymer; (5) thermoplastic elastomers, including block copolymers of styrene and butadiene, or isoprene or ethylene-butylene rubber, copoly(ether-amides), such as PEBAX® sold by Elf-Atochem, copoly(ether-ester) block copolymer elastomers sold as HYTREL® from DuPont and LOMOD® from GE; (6) saponified polymers and blends thereof, including saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer, such as carbon monoxide, sulfur dioxide, an anhydride, a glycidyl group and a vinyl ester with sufficient amount of an inorganic metal base; (7) co- and terpolymers containing glycidyl alkyl acrylate and maleic anhydride groups, including glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester; (8) high-crystalline acid copolymers and their ionomers, including acid copolymers or ionomer derivatives formed from an ethylene and carboxylic acid copolymer comprising about 5 to 35 wt % acrylic or methacrylic acid, wherein the copolymer is polymerized at a temperature of about 130° C. to 200° C. and a pressure of about 20,000 psi to 50,000 psi and wherein up to about 70% of the acid groups are neutralized with a metal ion; and (9) oxa acid compounds including those containing oxa moiety in the backbone having the formula:

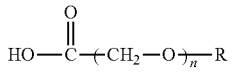

where R is an organic moiety comprising moieties having the formula:

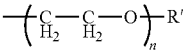

and alkyl, carbocyclic and heterocyclic groups; R' is an organic moiety comprising alkyl, carbocyclic, carboxylic acid, and heterocyclic groups; and n is an integer greater than 1. Also, R' can have the formula:

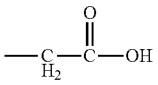

Preferably, the inner cover layers are comprised of polymers such as ethylene, propylene, butene-1- or hexane-1-based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the inner cover layer is preferably comprised of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 0-50 weight percent and Y is acrylic or methacrylic acid present in 5-35 weight percent. The acrylic or methacrylic acid is present in an amount of about 16-35 wt %, making the ionomer a high modulus ionomer, in an amount of about 10-12 wt %, making the ionomer a low modulus ionomer, or in an amount of about 13-15 wt %, making the ionomer a standard ionomer.

Preferably, the inner cover layers include polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

Suitable inner cover layer compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer.

The intermediate cover layer of the present invention preferably comprises a liquid polybutadiene rubber, a liquid styrenebutadiene rubber, or a liquid ethylene propylene diene monomer ("EPDM") rubber, but may also be formed from a variety of liquid rubber latex materials including, but not limited to, butadiene rubber emulsions, styrene-butadiene rubber emulsions, butyl rubber emulsions, natural rubber emulsions, asphalt rubber emulsions, bitumen rubber emulsions, nitrile-butadiene rubber emulsions, and ethylene-propylene copolymer rubber ("EPR") emulsions. Optionally, a free radical initiator and/or a coalescing agent/co-agent may be added to the emulsion to further enhance crosslinking after the latex has dried.

Suitable liquid rubbers are widely available from a number of commercial sources such as liquid EPDM or liquid EPR, commercially-available from Lion Copolymer and sold as TRILENE® liquid polymers (see TABLE I). TRILENE® 65 is an EPDM that uses dicyclopentadiene as the diene monomer, TRILENE® 67 is another EPDM that uses ethylidene norborene ("ENB") as the diene monomer, TRILENE® 77 (ENB) and TRILENE® CP80 (an ethylene propylene copolymer).

Liquid NBR (acrylonitrile butadiene copolymers) and Liquid NBR terpolymers (with isoprene or carboxylated NBRs) are sold by the Zeon Corp of Japan as NIPOL® N30L and DN601 (carboxylated) and DN1201 (terpolymer of acrylonitrile-butadiene-isoprene). Liquid isoprene rubber and copolymers thereof, such as LIR-30 (liquid isoprene), LIR-310 (styrene-isoprene), LIR-390 (butadiene-isoprene), LIR-403 and -410 (carboxylated isoprene), UC-1 (methacrylated isoprene), LIR-700 (latex isoprene), and LIR-300 (liquid BR), are suitable for the intermediate cover layers of the invention and are commercially-available from Kuraray Co. of Japan. Liquid polybutadiene resins, such as RICON® 151 (MW 2000), RICON® 153 (MW 2800), and other RICON® grades including RICON® 131, 142, 184 (liquid SBR) and maleated versions like RICOBOND® 1031, 1731 and 1756, are suitable for the intermediate cover layers of the invention and are commercially-available from Sartomer Materials.

In accordance to one aspect of the present invention, castable liquid rubber compositions, such as liquid polybutadiene, are used in golf balls. These compositions preferably have castable liquid polybutadiene as the principal rubber component. The liquid polybutadiene composition is preferably cast, and reacted or cured to form solid layer(s) in a golf ball. Advantages from using a castable liquid polybutadiene include the ability to form geometrically challenging layers and the ability to form very thin layers. A durable and aesthetically pleasing cover layer can also be formed from castable liquid polybutadiene. Solid innermost core and/or intermediate layer(s) can also be made from castable liquid polybutadiene.

Liquid polybutadienes are low molecular weight polymers, which are clear liquid at room temperature and whose main chain has a microstructure composed of vinyl-1,2 isomer, trans-1,4 isomer and cis-1,4 isomer. Preferably, the vinyl-1,2 isomer content is less than 30% by weight to protect low temperature properties of the cast layer. The molecular weight of liquid polybutadiene is at least about 1,000, preferably at least about 2,000, and more preferably at least about 5,000. In a preferred embodiment, the viscosity of liquid polybutadiene is less than about 10,000 cp and more preferably less than about 1,000 cp.

Liquid polybutadiene can be functionalized with epoxy, (meth)acrylate, hydroxyl, vinyl, isocyanate, ester, carboxyl and carbonyl groups. The epoxy and (meth)acrylate groups are preferred, because polymerization can be photo-induced by either free radical or cationic mechanism. Photo-polymerization, photo-curing or photo-crosslinking can be utilized in making thin films and coatings from liquid polyurethane.

Liquid polybutadienes, such as (meth)acrylated liquid polybutadiene, epoxidized liquid polybutadiene, liquid polybutadiene dimethacrylate, and liquid polybutadiene urethane diacrylate, are commercially-available as RICACRYL® and POLY BD® from the Sartomer Company of Exton, Pa. Other suitable liquid polybutadienes include NISSEKI® POLYBUTADIENE B-3000 from Nippon Oil Company; KURARAY® LIR-300 from Kuraray Company;

TABLE I

| Product | Monomer | s.g. | Diene (wt. %) | E/P ratio | M/v | Mw | Viscosity (60° C.) | Viscosity (100° C.) |
|---|---|---|---|---|---|---|---|---|
| TRILENE ® 65 | DCPD | 0.86 | 10.5 | 50/50 | 7,000 | 49,000 | 1,900,000 | 177,000 |
| TRILENE ® 67 | ENB | 0.86 | 9.5 | 46/56 | 7,200 | 42,000 | 900,000 | 128,000 |
| TRILENE ® 77 | ENB | 0.86 | 10.5 | 75/25 | 7,500 | 40,000 | 800,000 | 102,000 |
| TRILENE ® CP80 | EP | 0.86 | | 43/57 | 8,000 | 44,000 | 500,000 | 76,000 |

Lion Copolymer also sells ROYALENE® and ROYALEDGE® liquid EPDM products, as well as ROYALTHERM®, a silicone-modified EPDM. All of these, and other liquid rubbers disclosed herein, are vulcanizable with conventional peroxides or sulfur/accelerator systems, and are suitable for the intermediate cover layers of the invention.

R-45HT from Idemitsu Petrochemical Company, Ltd.; and KRASOL® liquid polybutadiene from Krasol Company.

In one example, a (meth)acrylate functionalized liquid polybutadiene is cast as an intermediate cover layer to a uniform thickness of about 5 mils. The thin film is then cured under mercury vapor lamp to crosslink the film using ultraviolet rays. The wattage and time under the lamp can be calibrated to cure the entire thickness of the film. The cured film exhibits superior hydrolytic stability and low transmission to water vapor. Cured thin films of liquid polybutadiene are also resistant to aqueous acidic and basic solutions. The film can be semi-cured so that it retains its shape and the film is then completely cured in a compression mold. The semi-cured film can also be shaped into hemispherical shells and molded on a golf ball core.

Liquid polybutadiene without any functional group (commercially-available as KRASOL® LB) is vulcanized with a reactive co-agent, a peroxide and/or a sulfur. The heat necessary for vulcanization is provided by casting or injection molding processes. The preferred manufacturing method is casting, similar to the casting processes for making polyurethane covers disclosed in U.S. Pat. Nos. 5,006,297; 5,733,428; and 6,132,324, which are incorporated herein by reference in their entireties.

As used herein, the term castable means capable of being cast into one or more layers in a golf ball. The castable liquid polybutadiene compositions of the present invention can be cast, compression molded or injection molded, as well as being made by other manufacturing techniques into one or more layers in a golf ball. The present invention is therefore not limited to any particular manufacturing technique.

Suitable co-agents for use in this invention include, but are not limited to, an unsaturated carboxylic acid or an unsaturated vinyl compound. For liquid polybutadiene, the preferred reactive co-agent is an unsaturated vinyl compound. A preferred unsaturated vinyl is trimethylolpropane trimethacrylate, commercially-available as SR-350 from Sartomer. Trimethylolpropane trimethacrylate is particularly suitable because it is a clear liquid at room temperature and can be readily mixed with the liquid polybutadiene.

A crosslinking agent may be included to increase the hardness of the liquid rubber intermediate layer. Suitable crosslinking agents include one or more metallic salts of a carboxylic acid, such as acrylic acid. Preferred crosslinking agents include zinc acrylate, zinc diacrylate, zinc methacrylate, and zinc dimethacrylate, and mixtures thereof. The crosslinking agent must be present in an amount sufficient to crosslink a portion of the chains of polymers in the resilient polymer component. For example, the desired compression may be obtained by adjusting the amount of crosslinking. This may be achieved, for example, by altering the type and amount of crosslinking agent. The crosslinking agent is typically present in an amount greater than about 0.1 percent of the resilient polymer component, i.e., the castable liquid polybutadiene, preferably from about 10 to 40 percent of the resilient polymer component, more preferably from about 10 to 30 percent of the resilient polymer component. When an organosulfur is selected as the cis-to-trans catalyst, zinc diacrylate may be selected as the crosslinking agent and is preferably present in an amount of less than about 25 phr. Suitable commercially-available, zinc diacrylates include those from the Sartomer Corporation. Zinc diacrylate is available in solid powder form that can be suspended in the liquid reactive co-agent, such as trimethylolpropane trimethacrylate, to be crosslinked with castable liquid polybutadiene.

A free radical initiator can be used to promote the crosslink reaction between reactive co-agent and polybutadiene. The free radical initiators may be any known polymerization initiators that decompose during the curing cycle. Suitable initiators include peroxides. Examples of the peroxides for the purposes of the present invention include dicumyl peroxide, n-butyl-4,4-di(t-butylperoxy)-valerate, 1,1-bis(t-butylperoxy)-3,3,5-trimethylcyclohexane, α,α'-bis(t-butylperoxy)-diisopropylbenzene, 2,5-dimethyl-2,5-di(t-butylperoxy)hexane, di-t-butyl peroxide, di-t-amyl peroxide, di(2-t-butylperoxyisopropyl)benzene peroxide, lauryl peroxide, benzoyl peroxide, t-butyl hydroperoxide, and mixtures thereof. Preferably, the peroxide initiator is dicumyl peroxide having an activity between about 40% and about 100%. Also preferably, the initiator is present in the polybutadiene blend in an amount ranging between about 0.05 phr and about 15 phr by weight of polybutadiene. More preferably, the amount of the initiator ranges between about 0.1 phr and about 5 phr, and most preferably between about 0.25 and about 1.5 phr. Preferably, the peroxide selected is in liquid form. The amount of peroxide used should be measured to minimize premature reaction.

Other suitable liquid materials for the intermediate cover layers of the invention include, but are not limited to, latex materials, liquid polybutadiene, liquid isoprene, liquid block copolymers, liquid silicones, epoxies, castable urethanes, any emulsified elastomer, many paints and coatings. Latex material means any material that when in a solid state can be extended under ambient conditions at least twice its resting length, and upon stress release can return to within 15% of its original length. Some examples of suitable latex materials include, but are not limited to, latexes of natural rubber, latexes of synthetic rubbers including isoprene and neoprene, acrylic latex, nitrile latex, polychloroprene latex, stryene-butadiene latex, vinyl pyridine latex, and liquid isoprene. The preferred method of application of the liquid is submersion of the core in a bath; however, other methods can be used. It is useful in this invention that the liquid dry to a reasonably tack-free film or a film which can be rendered tack-free by exposure to heat or radiation.

The preferred liquid material is a heavy latex material, which forms a heavy latex film. A heavy latex film is formed with about 30% to about 70% solids and applied using submersion times of about 10 seconds to about 60 seconds. However, a heavy latex film can be formed with less than 30% solids, if the submersion time is increased accordingly or with more than 70% solids if the submersion time is decreased accordingly. The preferred heavy latex material has about 52% solids and is applied using a submersion time of about 30 seconds. Suitable commercially-available latex materials include NATURAL LATEX COMPOUND 001704 from Heveatex Corporation, and HARTEX® 103, a polyisoprene latex from Hartex. The dip process seeks to create a heavier application of latex through the use of a higher solids content and/or longer submersion times.

Liquid EPDMs that have been modified to allow for silane crosslinking, namely a base rubber layer formed of a composition containing the following components (A) to (C): (A) a liquid polymer having a structural unit (α) derived from at least one of butadiene and isoprene and having an alkenyl group in a side chain thereof; (B) a hydrosilylation crosslinking agent; and (C) a hydrosilylation catalyst. In the conductive roll the alkenyl group of the structural unit (α) in the liquid rubber (component A) becomes a crosslinking site and is present in a molecule thereof as a so-called pendant form so that the base rubber layer as a crosslinked mold comes to have a dense net structure due to the effects by the hydrosilylation crosslinking agent (component B) and the hydrosilylation catalyst (component C).

A liquid epoxy composition that contains an elastomeric component is also suitable for the intermediate cover layers of the invention. In particular, a liquid sprayable epoxy composition comprising a liquid epoxy resin, an effective reinforcing amount of a fiber, an elastomeric component, and an amine containing epoxy curing agent capable of curing the composition at equal or greater than 40° F. temperatures wherein the cured product is light stable, is preferred.

One suitable material for the intermediate layers of the present invention are liquid epoxy compositions. A wide variety of liquid epoxy materials can be employed as long as they can be sprayable. The epoxy resins can be glycidated resins, cycloaliphatic epoxy resins, epoxidized oils and the like. Frequently, the glycidated resins are reaction products of glycidyl ether and bisphenol material such as BPA (bisphenol acetone reaction product) or BPF (bisphenol formaldehyde reaction product) and epichlorohydrin. Other epoxy materials are epoxidized polyalkylene glycol derivatives. The epoxy material may also be derived from phthalic acid, diglycidyl ester, dicyclopentadiene diepoxide, and the like.

Another useful class of polyepoxide materials are those that can be prepared from NOVOLAK® resins or similar polyphenol resins. A class of polyepoxides that may likewise be employed is acrylic polymers containing epoxy groups. Preferably, these acrylic polymers may be prepared by polymerizing glycidyl acrylate or methacrylate, a hydroxy containing unsaturated monomer and at least one other unsaturated monomer.

Typical epoxy resins are those having an epoxy equivalent of between about 100 and 800. It is preferred that the epoxy material be a liquid at room temperature. This can be accomplished by the epoxy being a liquid itself, or that it may be solubilized in a desirable solvent as described below. In some instances, the epoxy material may be particulate in nature as long as the particle size is not so large as to interfere with the desire for spraying the composition.

The elastomer component can be added to the composition either as a separate material or as a component or portion of the epoxy composition. Elastomers such as natural rubber, styrene butadiene, polybutadiene, polyisoprene, ethylene propylene, chloroprene, acrylonitrile-butadiene, ethylene-propylenediene monomer, butyl rubber such as isopreneisobutylene and the like may also be used. A preferred material, however, is an epoxy that has contained therein the elastomeric component, that is, the elastomer segments are grafted onto the epoxide chain or groups. In other words, the epoxy and elastomer components are in a single resinous system or material. These resins are commercially-available as HELOXY® WC-8006 from Hexion Specialty Chemicals of Columbus, Ohio. Another resin is KELPDXY® G 293-100 commercially-available from Spencer Kellogg Products for a concentrate of an epoxy terminated elastomeric copolymer which exhibits, in the cured state, elastomer particles of 0.01-10 microns in diameter which block the propagation of cracks and absorb strain energy). Alternatively, one may use an epoxy resin, such as CMD® 50735 from Interez, Inc., for an epoxy resin having both epoxide groups and reactive unsaturation and having an epoxide equivalent weight of 220.

In one embodiment, the three-layer cover is formed from an inner cover layer that is thermoplastic and has a material hardness of about 60 to 80 Shore D. The outer cover layer is formed from a thermoset polyurethane, polyurea, or hybrid thereof, and has a material hardness of about 20 to 60 Shore D. The intermediate cover layer is preferably thermoset and, in one embodiment, has a hardness substantially the same as the inner cover layer hardness and both layers have a hardness that is greater than the outer cover layer hardness. Alternatively, the intermediate cover layer hardness is less than the hardness of the inner cover layer but greater (harder) than the outer cover layer. The inner cover may be formed from a stiff resilient polymer and the intermediate layer may be formed from a thermoset liquid rubber composition comprising a liquid polybutadiene rubber, a liquid styrenebutadiene rubber, or a liquid EPDM polymer.

The liquid rubber composition may further include a crosslinking agent comprising one or more metallic salts of a carboxylic acid. In a preferred embodiment, the liquid rubber composition is a polybutadiene vulcanized with a reactive co-agent, a peroxide, a sulfur, or a mixture thereof. In an alternative preferred embodiment, the liquid rubber composition is a polybutadiene functionalized with epoxy, (meth) acrylate, hydroxyl, vinyl, isocyanate, ester, carboxyl, or carbonyl groups. Additionally, the liquid rubber composition is a polybutadiene comprising (meth)acrylated liquid polybutadiene, epoxidized liquid polybutadiene, liquid polybutadiene dimethacrylate, and liquid polybutadiene urethane diacrylate. In one further embodiment, the liquid rubber is an EPDM polymer comprising ethylidene norborene diene monomer or dicyclopentadiene.

The stiff resilient polymer for the inner cover layer may be a partially- and fully-neutralized ionomer, polyolefin, metallocene, polyester, polyamide, thermoplastic elastomer, copolyether-amide, copolyether-ester, or a mixtures thereof. A combination of the inner cover, the intermediate cover, and the outer cover preferably have a total thickness of about 0.125 inches or less, more preferably about 0.115 inches or less. The outer cover layer is typically cast or reaction injection molded.

Alternatively, the three-layer cover includes a thermoplastic inner cover layer disposed directly about the core and having a material hardness of about 60 to 80 Shore D; a thermoset outer cover layer formed from a castable polyurea and having a material hardness of about 20 to 60 Shore D; and a thermoset intermediate cover layer disposed between the inner and outer cover layers and having a hardness substantially the same as the inner cover layer hardness and greater than the outer cover layer hardness. The inner cover layer is formed from a high-acid ionomer and the intermediate cover layer is formed from a castable liquid polybutadiene rubber. The inner cover layer may further include a maleic anhydride modified polyolefin.

Still further, the three-layer cover may include a thermoplastic inner cover layer disposed about the core and having a material hardness of about 60 to 80 Shore D; a thermoplastic polyurethane outer cover layer having a material hardness of about 20 to 60 Shore D; and a thermoset intermediate cover layer disposed between the inner and outer cover layers and having a hardness substantially the same as the inner cover layer hardness and greater than the outer cover layer hardness. The inner cover layer may include one or more low-acid ionomers and the intermediate cover layer is typically formed from a ethylene propylene diene monomer-based liquid rubber polymer. The inner cover layer may be a blend of Li and Na low-acid ionomers. The outer cover layer is typically cast or reaction injection molded.

Any curing agents that are employed in the present application are preferably aliphatic amines or cyclo aliphatic amines. It is most preferred that one of the crosslinking agents be a tertiary amine containing material. The aliphatic amines may be alkylene diamines, such as ethylene or propylene diamine; triethylene diamine; piperazine-n-ethylamine; polyoxyalkylene diamines, such as polyoxyethylene diamine or polyoxypropylene diamine, and the like. Cycloaliphatic amines, such as hexahydrocyclohexane diamine and isopherone diamine, may be used. Aromatic amines frequently are employed as a catalyst for the polymerization inducing crosslinking of the epoxy material itself by inducing reaction between the epoxy group or a reaction between the epoxide group and hydroxyl groups. Tertiary amines are preferably employed, such as benzyldimethyl amine, Lewis acids and/or Mannich base such as boron trifluoride monoethyl amine or imidazoles, and the like. Another suitable tertiary amine includes tris(dimethylaminomethyl)phenol.

Any of the above intermediate layer materials may also include additives, such as anti-oxidants, dyes, pigments, colorants, stabilizers, flame retardants, drip retardants, crystallization nucleators, metal salts, antistatic agents, plasticizers, lubricants, and combinations comprising two or more of the foregoing additives. Effective amounts are typically less than 5 wt %, based on the total weight of the composition, preferably 0.25 wt % to 2 wt %.

The compositions may also comprise fillers, including reinforcing fillers. Exemplary fillers include small particle minerals (e.g., clay, mica, talc, and the like), glass fibers, nanoparticles, organoclay, and the like and combinations comprising one or more of the foregoing fillers. Fillers are typically used in amounts of 5 wt % to 50 wt %, based on the total weight of the composition. In one example, the cast liquid polybutadiene layer may include high density metal or metal alloy powder fillers to increase the rotational moment of inertia of the golf ball to reduce initial spin rate. The cast liquid polybutadiene layer may also include filler or fibers that alter the flexural modulus or the hardness of the layer.

One suitable mold for forming the intermediate layers of the invention includes a top plate and bottom plate, which contain cups. Each cup is adapted to receive a plurality of pins, which can be fixed pins or retractable pins. The pins keep the core (or core including inner cover layer) centered in the mold, so that the intermediate layer has a constant thickness. Liquid polybutadiene, for example, is poured into the cups through a nozzle and may also coat the core. Liquid polybutadiene may be premixed with any curing agents or additives. The amount of polybutadiene poured into the mold is pre-measured to give intermediate layer the desired thickness. Due to the flowing nature of liquid polybutadiene, as the mold cups are closed with the core/inner cover in between, liquid polybutadiene flows around the core to form the intermediate layer. The mold can also have a plurality of channels to communicate hot liquid to heat and cure the liquid polybutadiene or cold liquid to cool the mold before the mold is opened.

Alternatively, other materials such as reactive co-agent(s), accelerant(s), free radical initiator(s), cis-to-trans isomer catalyst(s), and fillers, among others, can be mixed with liquid polybutadiene in a mixer before being poured into the cups. The mixer can also have an optional insulative sleeve, which retains the heat from any exothermic reaction within the mixing chamber. Also, the intermediate layer material, such as liquid polybutadiene, can be at least partially cured to the core/inner cover and retained in the top cup by a vacuum, before more liquid polybutadiene is poured into the bottom cup to be cured to the core/inner cover combination.

While the inventive golf ball may be formed from a variety of differing cover materials, preferred outer cover layer materials include, but are not limited to, (1) polyurethanes, such as those prepared from polyols or polyamines and diisocyanates or polyisocyanates and/or their prepolymers, and those disclosed in U.S. Pat. Nos. 5,334,673 and 6,506,851; (2) polyureas, such as those disclosed in U.S. Pat. Nos. 5,484,870 and 6,835,794; (3) polyurethane-urea hybrids, blends or copolymers comprising urethane or urea segments; and (4) other suitable polyurethane compositions comprising a reaction product of at least one polyisocyanate and at least one curing agent are disclosed in U.S. Pat. Nos. 7,105,610 and 7,491,787, all of which are incorporated herein by reference.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Pat. No. 7,331,878, which is incorporated by reference in its entirety.

Exemplary polyisocyanates suitable for use in the outer cover layers of the invention include, but are not limited to, 4,4'-diphenylmethane diisocyanate (MDI); polymeric MDI; carbodiimide-modified liquid MDI; 4,4'-dicyclohexylmethane diisocyanate; p-phenylene diisocyanate (PPDI); m-phenylene diisocyanate; toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer isocyanate groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 8.0% NCO, more preferably no greater than about 7.8%, and most preferably no greater than about 7.5% NCO with a level of NCO of about 7.2 or 7.0, or 6.5% NCO commonly used.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2', 3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially-available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy} benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy} benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form one or more of the cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, that a catalyst may be employed to promote the reaction between the curing agent and the isocyanate and polyol, or the curing agent and the prepolymer.

Saturated diisocyanates which can be used include, without limitation, ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate; methyl cyclohexylene diisocyanate; triisocyanate of HDI; triisocyanate of 2,2,4-trimethyl-1,6-hexane diisocyanate. The most preferred saturated diisocyanates are 4,4'-dicyclohexylmethane diisocyanate and isophorone diisocyanate.

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and polytetramethylene ether glycol-initiated polycaprolactone. The most preferred saturated polyols are polytetramethylene ether glycol and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis- (sec-butylamino)cyclohexane; 1,4-bis-(sec-butylamino) cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystyrene block copolymers (such as styrene-butadiene-styrene), styrene-ethylene-propylene-styrene, styrene-ethylene-butylene-styrene, and the like, and blends thereof. Thermosetting polyurethanes or polyureas are suitable for the outer cover layers of the golf balls of the present invention.

Additionally, polyurethane can be replaced with or blended with a polyurea material. Polyureas are distinctly different from polyurethane compositions, but also result in desirable aerodynamic and aesthetic characteristics when used in golf ball components. The polyurea-based compositions are preferably saturated in nature.

Without being bound to any particular theory, it is now believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine, and at least one diol curing agent or at least one diamine curing agent.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof. In one embodiment, the polyether amine used to form the prepolymer is JEFFAMINE® D2000 from Huntsman Chemical Co. of Austin, Tex.

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, more preferably is between about 1500 to about 2500, and most preferably from 2000 to 2500. Because lower molecular weight polyether amines may be prone to forming solid polyureas, a higher molecular weight oligomer, such as JEFFAMINE® D2000, is preferred.

Other suitable castable polyurea compositions for use in the golf balls of the present invention include those formed from the reaction product of a prepolymer formed from an isocyanate and an amine-terminated polytetramethylene ether glycol and an amine-terminated curing agent, and those formed from the reaction product of a polyurea prepolymer cured with an amine-terminated polytetramethylene ether glycol. In either scenario, the amine-terminated polytetramethylene ether glycol is terminated with secondary amines. In addition, the amine-terminated polytetramethylene ether glycol may be a copolymer with polypropylene glycol, wherein the polytetramethylene ether glycol is end-capped with one or more propylene glycol units to form the copolymer.

Another suitable composition includes a prepolymer including the reaction product of an isocyanate-containing component and an amine-terminated component, wherein the amine-terminated component includes a copolymer of polytetramethylene ether glycol and polypropylene glycol including at least one terminal amino group; and an amine-terminated curing agent. In this aspect of the invention the prepolymer may includes about 4 percent to about 9 percent NCO groups by weight of the prepolymer.

In one embodiment, the at least one terminal amino group includes secondary amines. In another embodiment, the at least one terminal amino group includes a terminal secondary amino group at both ends of the copolymer. In yet another embodiment, the amine-terminated curing agent includes a secondary diamine.

The polyureas of the present invention also include a polyurea composition formed from a prepolymer formed from the reaction product of an isocyanate-containing compound and an isocyanate-reactive compound, wherein the isocyanate-reactive compound includes polytetramethylene ether glycol homopolymer having a molecular weight of about 1800 to about 2200 and terminal secondary amino groups; and an amine-terminated curing agent. In this aspect of the invention, the prepolymer may include about 6 percent to about 8 percent NCO groups by weight of the prepolymer. In addition, the PTMEG homopolymer may have a molecular weight of about 1900 to about 2100. In one embodiment, the amine-terminated curing agent includes a secondary diamine.

In one embodiment, the polyalkylene glycol includes polypropylene glycol, polyethylene glycol, and copolymers or mixtures thereof. In another embodiment, the amino groups include secondary amino groups. The amine-terminated curing agent may include an amine-terminated polytetramethylene ether glycol. In one embodiment, the amine-terminated polytetramethylene ether glycol includes at least one terminal secondary amino group.

Conventional aromatic polyurethane/urethane elastomers and polyurethane/urea elastomers are generally prepared by curing a prepolymer of diisocyanate and long chain polyol with at least one diol curing agent or at least one diamine curing agent, respectively. In contrast, the use of a long chain amine-terminated compound to form a polyurea prepolymer has been shown to improve shear, cut, and resiliency, as well as adhesion to other components.

Without being bound to any particular theory, it has now been discovered that the use of an amine-terminated PTMEG and/or an amine-terminated copolymer of PTMEG and polypropylene glycol (PPG) in the prepolymer or as a curing agent provide enhanced shear, cut, and resiliency as compared to conventional polyurea elastomers. For example, the compositions of the invention have improved durability and performance characteristics over that of a polyurea composition formed with amine-terminated PPG.

The polyurea-based compositions of this invention may be formed in several ways: a) from a prepolymer that is the reaction product of an isocyanate-containing component and amine-terminated PTMEG chain extended with a curing agent; b) from a prepolymer that is the reaction product of an isocyanate-containing component and an amine-terminated copolymer of PTMEG and PPG chain extended with a curing agent; c) from a prepolymer that is the reaction product of a polyurea-based prepolymer chain extended with an amine-terminated PTMEG; and d) from a prepolymer that is the reaction product of a polyurea-based prepolymer chain extended with an amine-terminated copolymer of PTMEG and PPG.

For example, the compositions of the invention may be prepared from at least one isocyanate-containing component, at least one amine-terminated copolymer of PTMEG and PPG, preferably a secondary diamine, and at least one amine-terminated curing agent, preferably a secondary aliphatic diamine or primary aromatic diamine curing agent. The presence of PTMEG in the backbone provides better shear resistance as compared to a backbone including only PPG. Commercially-available amine-terminated PTMEG and/or copolymer of PTMEG and PPG include those sold by Huntsman Chemical under the tradenames XTJ-559, XTG-604, XTG-605, and XTG-653.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. Without being bound to any particular theory, it is believed that an amine with a high level of stearic hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK® 1000) may be suitable for use in combination with an isocyanate to form the polyurea prepolymer.

Any isocyanate available to one of ordinary skill in the art is suitable for use in the polyurea prepolymer. Isocyanates for use with the present invention include aliphatic, cycloaliphatic, araliphatic, aromatic, any derivatives thereof, and combinations of these compounds having two or more isocyanate (NCO) groups per molecule. The isocyanates may be organic polyisocyanate-terminated prepolymers. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms. The diisocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof. Copolymeric isocyanates, such as Bayer DESMODUR® HL, which is a copolymer of TDI and HDI, are preferred.

Examples of diisocyanates that can be used with the present invention include, but are not limited to, substituted and isomeric mixtures including 2,2'-, 2,4'-, and 4,4'-diphenylmethane diisocyanate; 3,3'-dimethyl-4,4'-biphenylene diisocyanate; toluene diisocyanate; polymeric MDI; carbodiimide-modified liquid 4,4'-diphenylmethane diisocyanate; p-phenylene diisocyanate; m-phenylene diisocyanate; triphenyl methane-4,4'- and triphenyl methane-4,4'-triisocyanate; naphthylene-1,5-diisocyanate; 2,4'-, 4,4'-, and 2,2-biphenyl diisocyanate; polyphenyl polymethylene polyisocyanate; mixtures of MDI and PMDI; mixtures of PMDI and TDI; ethylene diisocyanate; propylene-1,2-diisocyanate; tetramethylene-1,2-diisocyanate; tetramethylene-1,3-diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate; p-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Examples of saturated diisocyanates that can be used with the present invention include, but are not limited to, ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; and mixtures thereof. Aromatic aliphatic isocyanates may also be used to form light stable materials. Examples of such isocyanates include 1,2-, 1,3-, and 1,4-xylene diisocyanate; meta-tetramethylxylene diisocyanate; para-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In addition, the aromatic aliphatic isocyanates may be mixed with any of the saturated isocyanates listed above for the purposes of this invention.

The number of unreacted NCO groups in the polyurea prepolymer of isocyanate and polyether amine may be varied to control such factors as the speed of the reaction, the resultant hardness of the composition, and the like. For instance, the number of unreacted NCO groups in the polyurea prepolymer of isocyanate and polyether amine may be less than about 14%. In one embodiment, the polyurea prepolymer has from about 5% to about 11% unreacted NCO groups, and even more preferably has from about 6% to about 9.5% unreacted NCO groups. In one embodiment, the percentage of unreacted NCO groups is about 3% to about 9%. Alternatively, the percentage of unreacted NCO groups in the polyurea prepolymer may be about 7.5% or less, and more preferably, about 7% or less. In another embodiment, the unreacted NCO content is from about 2.5% to about 7.5%, and more preferably from about 4% to about 6.5%.

When formed, polyurea prepolymers may contain about 10% to about 20% by weight of the prepolymer of free isocyanate monomer. Thus, in one embodiment, the polyurea prepolymer may be stripped of the free isocyanate monomer. For example, after stripping, the prepolymer may contain about 1% or less free isocyanate monomer. In another embodiment, the prepolymer contains about 0.5% by weight or less of free isocyanate monomer.

The polyether amine may be blended with additional polyols to formulate copolymers that are reacted with excess isocyanate to form the polyurea prepolymer. In one embodiment, less than about 30% polyol by weight of the copolymer is blended with the saturated polyether amine. In another embodiment, less than about 20% polyol by weight of the copolymer, preferably less than about 15% by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5; dimethylthio-2,4-toluenediamine; 3,5-dimethylthio-2,6-toluenediamine; 3,5-diethylthio-2,4-toluenediamine; 3,5; diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety by reference thereto.

The outer cover is preferably formed around the core and intermediate cover layers by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the outer cover formation, mixing of the prepolymer and curative is accomplished in a motorized mixer including mixing head by feeding through lines metered amounts of curative and prepolymer. Top preheated mold halves are filled and placed in fixture units using pins moving into holes in each mold. After the reacting materials have resided in top mold halves for about 40 to about 80 seconds, a core is lowered at a controlled speed into the gelling reacting mixture. At a later time, a bottom mold half or a series of bottom mold halves have similar mixture amounts introduced into the cavity.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. Nos. 5,006,297 and 5,334,673 both disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety.

Other methods of molding include reaction injection molding (RIM) where two liquid components are injected into a mold holding a pre-positioned core. The liquid components react to form a solid, thermoset polymeric composition, typically a polyurethane or polyurea.

An optional filler component may be chosen to impart additional density to blends of the previously described components. The selection of such filler(s) is dependent upon the type of golf ball desired (i.e., one-piece, two-piece multi-component, or wound). Examples of useful fillers include zinc oxide, barium sulfate, calcium oxide, calcium carbonate and silica, as well as the other well known corresponding salts and oxides thereof. Additives, such as nanoparticles, glass spheres, and various metals, such as titanium and tungsten, can be added to the polyurethane compositions of the present invention, in amounts as needed, for their well-known purposes. Additional components which can be added to the polyurethane composition include UV stabilizers and other dyes, as well as optical brighteners and fluorescent pigments and dyes. Such additional ingredients may be added in any amounts that will achieve their desired purpose.

The golf balls of the present invention typically have a COR of greater than about 0.775, preferably greater than about 0.795, and more preferably greater than about 0.800. The golf balls also typically have an Atti compression of at least about 40, preferably from about 50 to 120, and more preferably from about 60 to 110. As used herein, the term "Atti compression" is defined as the deflection of an object or material relative to the deflection of a calibrated spring, as measured with an Atti Compression Gauge, that is commercially-available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to normalize the diameter of the measured object to 1.680 inches.

It should be understood that there is a fundamental difference between 'material hardness' and 'hardness' (as measured directly on a curved surface, such as a golf ball). Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a different measurement and, therefore, many times produces a different hardness value. This difference results from a number of factors including, but not limited to, ball construction (i.e., core type, number of core and/or cover layers, etc.), ball (or sphere) diameter, and the material composition of adjacent layers (especially measuring soft, very thin layers over a layer from a harder material). It should also be understood that the two measurement techniques are not linearly related and, therefore, one hardness value cannot easily be correlated to the other. As used herein, the term "hardness" refers to hardness measured on the curved surface of the layer being measured (i.e., sphere including core+inner cover, sphere including core+inner cover+intermediate cover, or sphere including core+inner cover+intermediate cover+outer cover).

The inner cover layer has a hardness of about 45 to 68 Shore D, preferably about 50 to 62 Shore D, and more preferably about 52 to 60 Shore D. In preferred embodiments, the inner cover layer preferably has a hardness of 55 to 60 Shore D, more preferably 56 to 59 Shore D, most preferably 57 to 58 Shore D. Alternatively, the inner cover layer has a hardness of about 55 to 98 Shore C, preferably about 66 to 90 Shore C, and more preferably about 74 to 86 Shore C. In preferred embodiments, the inner cover layer preferably has a hardness of 76 to 85 Shore C, more preferably 78 to 84 Shore C, most preferably 80 to 83 Shore C.

The intermediate cover layer has a hardness of about 55 to 80 Shore D, preferably about 57 to 75 Shore D, and more preferably about 61 to 69 Shore D. Alternatively, the intermediate cover layer has a hardness of about 65 to 100 Shore C, preferably about 72 to 95 Shore C, and more preferably about 74 to 92 Shore C.

The outer cover layer has a hardness of about 35 to 65 Shore D, preferably about 40 to 62 Shore D, and more preferably about 52 to 60 Shore D. In preferred embodiments, the outer cover layer preferably has a hardness of 55 to 60 Shore D, more preferably 56 to 59 Shore D, most preferably 57 to 58 Shore D. Alternatively, the outer cover layer has a hardness of about 55 to 90 Shore C, preferably about 62 to 86 Shore C, and more preferably about 68 to 82 Shore C. In preferred embodiments, the outer cover layer preferably has a hardness of 76 to 85 Shore C, more preferably 78 to 84 Shore C, most preferably 80 to 83 Shore C.

In a particularly preferred embodiment, a golf ball is formed from a core, an inner cover layer, an intermediate cover layer, and an outer cover layer. The core is a single, solid core having an outer diameter of about 1.52 inches. The inner cover layer is formed from an ionomer and has a thickness of about 0.035 inches and a hardness of about 58 Shore D. Alternatively, the inner cover layer has a hardness of about 82 Shore C. The intermediate layer is formed from a polycarbonate/polyester blend and has a thickness of about 0.015 inches and a hardness of about 62 Shore D. Alternatively, the intermediate cover layer has a hardness of about 90 Shore C. The outer cover layer is formed from a thermosetting polyurea and has a thickness of about 0.030 inches and a hardness of about 57 Shore D. Alternatively, the outer cover layer has a hardness of about 80 Shore C.

The relationship between the inner cover layer, the intermediate cover layer, and the outer cover layer is also important to the golf ball of the present invention. The outer cover layer has a first hardness, the intermediate cover layer has a second hardness, and the inner cover layer has a third hardness. The non-ionomeric intermediate layer of the present invention has a hardness that is greater than the hardness of both the inner cover layer and the outer cover layer. The second hardness is at least 5 Shore D greater than the first and third hardness values, preferably at least 10 Shore D greater than the first and third hardness values, more preferably at least 15 Shore D greater than the first and third hardness values, and most preferably at least 20 Shore D greater than the first and third hardness values.

The core of the present invention has an Atti compression of between about 50 and about 90, more preferably, between about 60 and about 85, and most preferably, between about 70 and about 80. The outer diameter of the core is about 1.45 inches to 1.58 inches, more preferably about 1.50 inches to 1.56 inches, most preferably about 1.51 inches to 1.55 inches. The thickness of the inner cover layer is preferably about 0.010 inches to 0.075 inches, more preferably about 0.030 inches to 0.060 inches, most preferably about 0.035 inches to 0.050 inches. The thickness of the intermediate cover layer is preferably about 0.010 inches to 0.075 inches, more preferably about 0.030 inches to 0.060 inches, most preferably about 0.035 inches to 0.050 inches. In one alternative preferred embodiment, the thickness of the intermediate cover layer is about 0.015 inches to 0.030 inches. The thickness of the outer cover layer is preferably about 0.005 inches to 0.045 inches, more preferably about 0.020 inches to 0.040 inches, and most preferably about 0.025 inches to 0.035 inches.

The flexural modulus of the intermediate layer on the golf balls, as measured by ASTM method D6272-98, Procedure B, is typically greater than about 55,000 psi, and is preferably from about 60,000 psi to 120,000 psi. Preferably, the intermediate layer compositions of the invention have a higher flexural modulus at a particular hardness than the inner cover layer ionomeric materials at the same hardness.

The golf ball can have an overall diameter of any size. While the United States Golf Association limits the minimum size of a golf ball to 1.680 inches, there is no maximum diameter. The golf ball diameter is preferably about 1.68 inches to 1.74 inches, more preferably about 1.68 inches to about 1.70 inches, and most preferably about 1.68 inches.

While any of the embodiments herein may have any known dimple number and pattern, a preferred number of dimples is 252 to 456, and more preferably is 330 to 392. The dimples may comprise any width, depth, and edge angle disclosed in the prior art and the patterns may comprises multitudes of dimples having different widths, depths and edge angles. Typical dimple coverage is greater than about 60%, preferably greater than about 65%, and more preferably greater than about 75%. The parting line configuration of said pattern may be either a straight line or a staggered wave parting line (SWPL). Most preferably the dimple number is 330, 332, or 392 and comprises 5 to 7 dimples sizes and the parting line is a SWPL.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising a core and a three-layer cover, the cover comprising:

a thermoplastic inner cover layer disposed about the core and having a material hardness of about 60 Shore D to about 80 Shore D;

a thermoset outer cover layer comprising a polyurethane, polyurea, or hybrid thereof and having a material hardness of about 20 Shore D to about 60 Shore D; and a thermoset intermediate cover layer disposed between the inner and outer cover layers and having a hardness substantially the same as the inner cover layer hardness and greater than the outer cover layer hardness;

wherein the inner cover comprises a stiff resilient polymer, and the intermediate layer is formed from a thermoset liquid rubber composition comprising a liquid styrene-butadiene rubber, or a liquid ethylene propylene diene monomer (EPDM) polymer.

2. The golf ball of claim 1, wherein the liquid rubber composition comprises about 30% to about 70% solids at a submersion time of about 10 sec to about 60 sec.

3. The golf ball of claim 1, wherein the liquid rubber composition, when in a solid state, can be extended under ambient conditions at least twice its resting length, and upon stress release can return to within 15% of its original length.

4. The golf ball of claim 1, wherein the liquid rubber composition further comprises a crosslinking agent comprising one or more metallic salts of a carboxylic acid.

5. The golf ball of claim 1, wherein the liquid rubber composition is a polybutadiene vulcanized with a reactive co-agent, a peroxide, a sulfur, or a mixture thereof.

6. The golf ball of claim 1, wherein the liquid rubber composition is a polybutadiene functionalized with epoxy, (meth)acrylate, hydroxyl, vinyl, isocyanate, ester, carboxyl, or carbonyl groups.

7. The golf ball of claim 1, wherein the liquid rubber composition is a polybutadiene comprising (meth)acrylated liquid polybutadiene, epoxidized liquid polybutadiene, liquid polybutadiene dimethacrylate, and liquid polybutadiene urethane diacrylate.

8. The golf ball of claim 1, wherein the liquid rubber composition has a viscosity of about 10,000 cp or less.

9. The golf ball of claim 8, wherein the viscosity is about 1,000 cp or less.

10. The golf ball of claim 1, wherein the liquid rubber composition is vulcanized with peroxide or sulfur cure accelerators.

11. The golf ball of claim 1, wherein the EPDM polymer comprises ethylidene norborene diene monomer or dicyclopentadiene.

12. The golf ball of claim 1, wherein the stiff resilient polymer comprises partially- and fully-neutralized ionomers, polyolefins, metallocenes, polyesters, polyamides, thermoplastic elastomers, copolyether-amides, copolyether-esters, or mixtures thereof.

13. The golf ball of claim 1, wherein a combination of the inner cover, the intermediate cover, and the outer cover have a total thickness of 0.125 inches or less.

14. The golf ball of claim 1, wherein the total thickness is 0.115 inches or less.

15. The golf ball of claim 1, wherein the outer cover layer is cast or reaction injection molded.

16. A golf ball comprising a core and a three-layer cover, the cover comprising:

a thermoplastic inner cover layer disposed about the core and having a material hardness of about 60 Shore D to about 80 Shore D;

a thermoset outer cover layer comprising a castable polyurea and having a material hardness of about 20 Shore D to about 60 Shore D; and a thermoset intermediate cover layer disposed between the inner and outer cover layers and having a hardness substantially the same as the inner cover layer hardness and greater than the outer cover layer hardness;

wherein the inner cover layer comprises a high-acid ionomer and the intermediate cover layer is formed from a liquid ethylene propylene diene monomer (EPDM) polymer.

17. The golf ball of claim 16, wherein the inner cover layer further comprises a maleic anhydride modified polyolefin.

18. A golf ball comprising a core and a three-layer cover, the cover comprising:

a thermoplastic inner cover layer disposed about the core and having a material hardness of about 60 Shore D to about 80 Shore D;

a thermoplastic polyurethane outer cover layer having a material hardness of about 20 Shore D to about 60 Shore D; and a thermoset intermediate cover layer disposed between the inner and outer cover layers and having a hardness substantially the same as the inner cover layer hardness and greater than the outer cover layer hardness;

wherein the inner cover layer comprises one or more low-acid ionomers and the intermediate cover layer is formed from a ethylene propylene diene monomer-based liquid rubber polymer.

19. The golf ball of claim 18, wherein the inner cover layer comprise a blend of Li and Na low-acid ionomers.

20. The golf ball of claim 18, wherein the outer cover layer is cast or reaction injection molded.

* * * * *